US005129649A

United States Patent [19]

Scholz

[11] Patent Number: 5,129,649

[45] Date of Patent: Jul. 14, 1992

[54] METHOD OF PLAYING A BOARD GAME

[76] Inventor: George H. Scholz, Top of the World, Apt. 52, 2254 Norwegian Dr., Clearwater, Fla. 34623

[21] Appl. No.: 741,092

[22] Filed: Aug. 6, 1991

[51] Int. Cl.[5] ..... A63F 3/04

[52] U.S. Cl. ..... 273/236; 273/254; 273/302

[58] Field of Search ..... 273/236, 254, 302, 292; 434/150, 152, 153

[56] References Cited

U.S. PATENT DOCUMENTS

| | | | |
|---|---|---|---|
| 279,268 | 6/1883 | Norris | 434/150 |
| 787,295 | 4/1905 | Higgins | 273/302 |
| 1,273,024 | 7/1918 | Branch | 273/302 |
| 1,551,895 | 9/1925 | Magar | 434/150 X |
| 1,597,562 | 8/1926 | Allen | 434/150 |
| 2,199,499 | 5/1940 | Kreitler | 434/150 X |
| 3,347,550 | 10/1967 | Carboni | 273/230 X |
| 3,363,902 | 1/1968 | Jones | 273/230 X |
| 3,711,966 | 1/1973 | Dresak | 273/236 X |
| 4,552,357 | 11/1985 | Di Egidio | 273/236 X |
| 4,558,865 | 12/1985 | Isgar | 273/302 X |
| 4,824,119 | 4/1989 | Matthews | 273/302 X |
| 4,923,198 | 5/1990 | Diaz | 273/254 X |
| 4,988,108 | 1/1991 | Shepard | 273/254 |

*Primary Examiner*—William H. Grieb
*Attorney, Agent, or Firm*—Herbert W. Larson

[57] ABSTRACT

Using a game board having all fifty U.S. state flags depicted together with groups of contiguous states. Employing fifty playing cards, with each card naming a separate U.S. state and listing multiple cities located in the state, bonus cards naming cities and play money. Each player, in turn, reads the name of the state and the listed cities on a playing card, selects the capitol city of the state, selects the geographical location of the state on the game board and selects the corresponding state flag. Play money is awarded for correct answers and the person with the most play money at the end of the game is declared the winner.

3 Claims, 3 Drawing Sheets

10

METHOD OF PLAYING A BOARD GAME

BACKGROUND OF THE INVENTION

1. Field of The Invention

This invention relates to an educational board game. More particularly, it refers to a method of playing a board game teaching players geographical locations within the United States.

2. Description of The Prior Art

Educational maps such as set forth in U.S. Pat. Nos. 279,268; 1,597,562 and educational map games such as set forth in U.S. Pat. Nos. 1,551,895; 2,199,499; 3,347,550; 3,363,902; 3,711,966; and 4,552,357 are known learning tools for a geography education. Although each of these prior references accomplish a geography learning step they do not generate enough excitement and interest to make them popular games. A geographical learning game is needed which is both educational and exciting to stimulate the interest in geography of the players.

SUMMARY OF THE INVENTION

I have invented a geography learning game that stimulates interest in U.S. state capitols and other cities within the fifty U.S. states.

The method of my game involves a playing board with all the state flags delineating an outer perimeter of the board and various groups of states separately set forth within the perimeter, together with a set of playing and bonus cards.

One to eight players can play the game at one time. The fifty playing cards each list a state with its abbreviation and fourteen cities within the state. A player choosing a playing card must announce the state and its abbreviation, name the state capitol after reading the fourteen city names and locate the state within the correct group of states on the playing board and point out the state flag. Bonus cards list cities or places and a player is required to name the state or states that encompasses that city or place. Play money is dispensed upon giving the correct answer and the player with the most money after all fifty playing cards are used is declared the winner.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
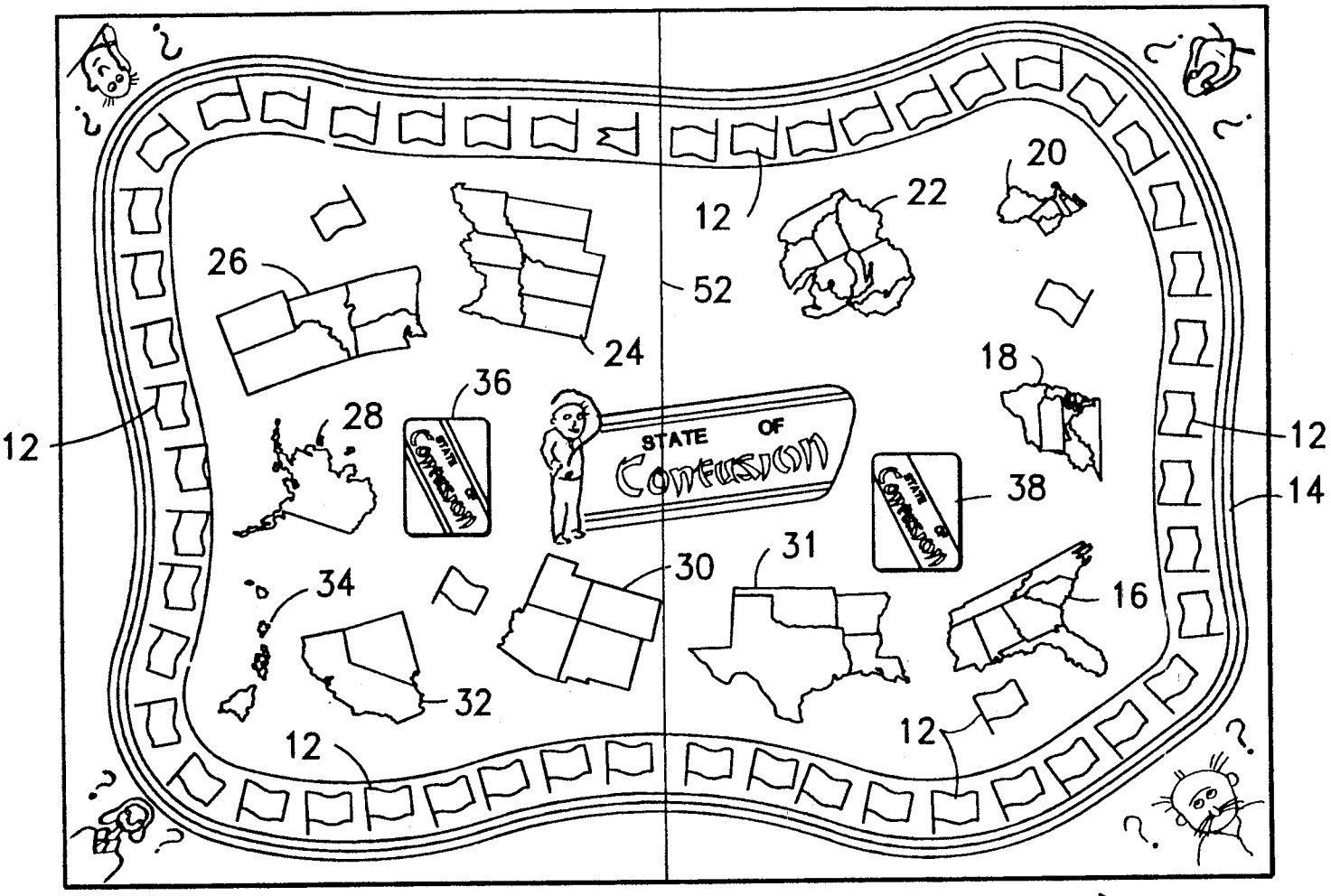
FIG. 1 is a top plan view of the game board.

Throughout the following detailed description, the same reference numerals refer to the same elements in all figures.

The game board 10 shown in FIG. 1 has each of the fifty states represented by their state flags 12 set forth around the periphery 14 of the game board 10. Groups of regional states are shown on the board; 16 being the southeastern United States 18 being the middle Atlantic states; 20 being the New England states; 22 being the Great Lakes states; 24 being all the Northern Mid-West states; 26 being the North Western states; 28 being Alaska; 30 the Southern Western states; 31 the Southern. Mid-Western States; 32 California and Nevada and 34 Hawaii. Also located on the playing board 10 is a pile of playing cards 36 and a pile of bonus cards 38.

Figure 2:
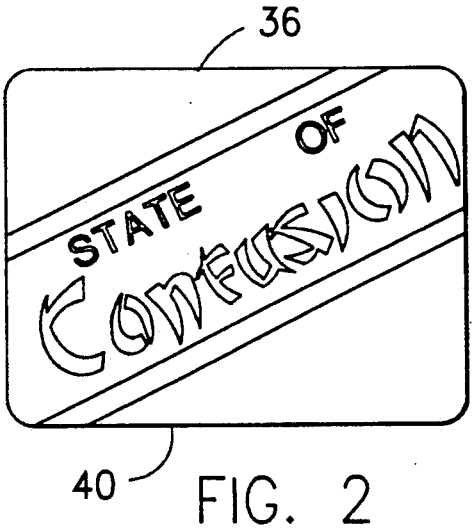
FIG. 2 is a top plan view of a playing card.
Figure 3:
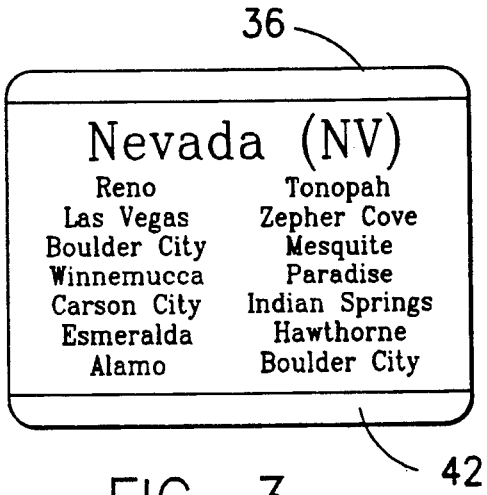
FIG. 3 is a bottom plan view of a playing card.
Figure 4:
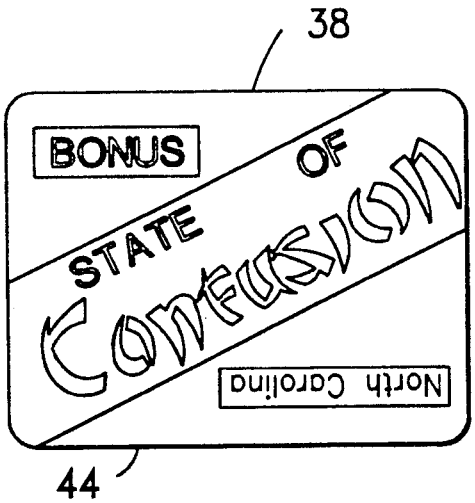
FIG. 4 is a top plan view of a bonus card.
Figure 5:
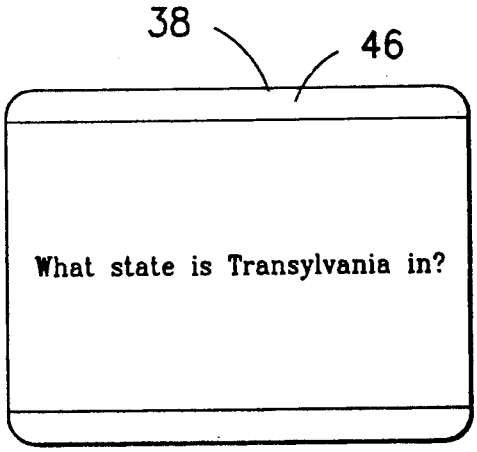
FIG. 5 is a bottom plan view of a bonus card.

As seen in FIG. 2, the top surface 40 of the playing cards 36 merely shows a name for the game, such as State of Confusion and the bottom surface 42 of the playing cards 36, has the state name and abbreviation, as well as fourteen cities within the state. The object of a player selecting a given card is to read the name of the state and its abbreviation to the other players, as well as the fourteen cities. The player then selects the correct state capitol, points out the geographical location of the state and the state flag and receives play money as a reward. If he names a correct capitol, he also gets to choose a bonus card 38 which has on a top surface 44 the word BONUS and the answer to the question set forth on the bottom surface 46. The bonus cards are placed in such a configuration that the answer is not shown to the player and the bottom surface question is asked, such as what state is Transylvania in? The player must then answer North Carolina and if the correct state is given, the player receives play money. Thereafter, a player completes his turn. The player to his/her left continues with the game by selecting a new playing card.

Figure 6:
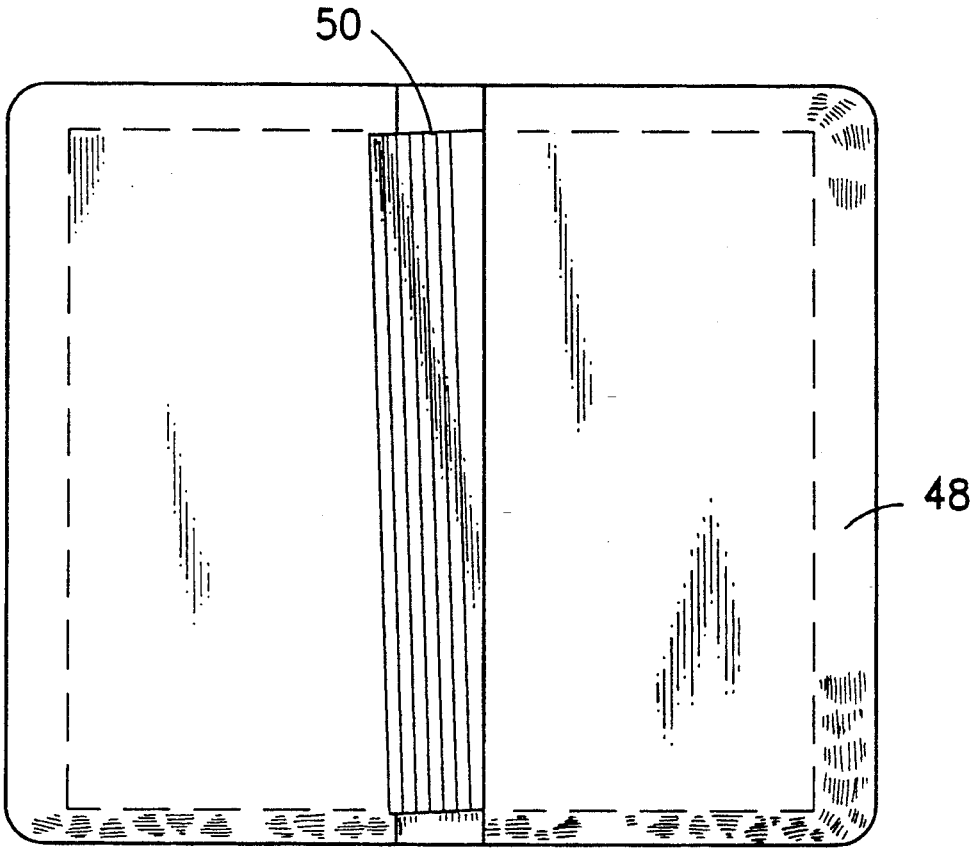
FIG. 6 is a money pouch for each player.
Figure 7:
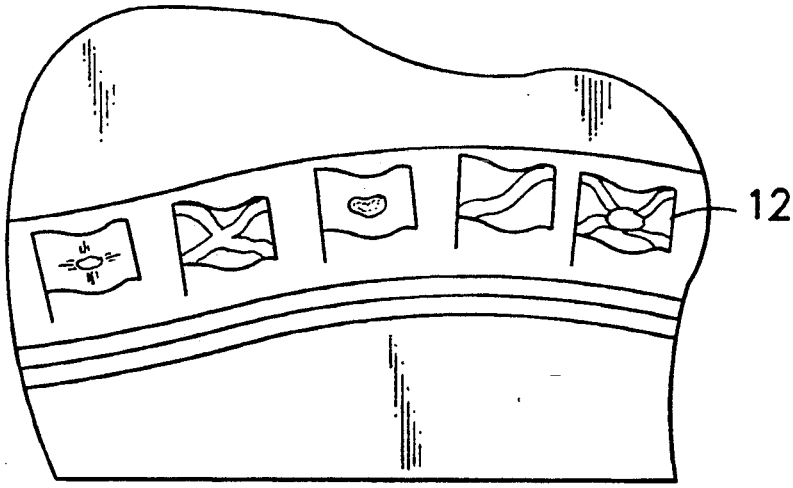
FIG. 7 is a top sectional plan view of a group of state flags shown on the board.

At any time, a player can challenge another player to name any number of cities in a given state and each player can wager money within their pile to see if a correct answer can be given. Each player has a money pouch 48 shown in FIG. 6 with play money 50 available for making bets or accumulating to determine a winner after all fifty playing cards 36 have been selected. The state flags 12 as shown in FIG. 6 can be used as additional challenges from one player to another. For instance, the player might challenge another player to name the state corresponding to any given flag on the board.

The player correctly pronouncing all the names on his playing card, receives $5.00, naming the state capitol, the player receives $5.00. The player naming a state with a city, also located in two or more states, receives $5.00. Naming a person, battle, product or crop or anything pertinent to that state, is another $5.00. A player identifying the corresponding state emblem on the game board receives $20.00 and a player naming the states, geographical position on the board receives $5.00.

The game cards 36 have the following cities set forth corresponding to the states on each card:

| | |
|---|---|
| ALABAMA (AL) | |
| HUNTSVILLE | CHEROKEE |
| BIRMINGHAM | MOBILE |
| LOUISVILLE | MADISON |
| NOTASULGA | TUSCALOOSA |
| FRANKLIN | TALLAPOOSA |
| ESCAMBIA | SYLACAUGA |
| DECATUR | MONTGOMERY |
| ALASKA (AK) | |
| ANCHORAGE | NOME |
| BARROW | NOORVIK |
| FAIRBANKS | SITKA |
| JUNEAU | SKAGWAY |
| KETCHIKAN | UNALASKA |
| KODIAK | VALDEZ |

-continued

| | |
|---|---|
| NIKISHKA | FT. YUKON |

ARIZONA (AZ)

| | |
|---|---|
| APACHE | MOHAVE |
| DOUGLAS | PHOENIX |
| FLAGSTAFF | PRESCOTT |
| GILA BEND | SCOTTSDALE |
| GRAND CANYON | TOMBSTONE |
| KINGMAN | TUSCON |
| LUKACHUKAI | YUMA |

ARKANSAS (AR)

| | |
|---|---|
| PINE BLUFF | DECATUR |
| FAYETTEVILLE | HARRISBURG |
| LITTLE ROCK | HOT SPRINGS |
| TEXARKANA | INDEPENDENCE |
| FORT SMITH | MARMADUKE |
| ARKADELPHIA | MURFREESBORO |
| BOONEVILLE | POCOHONTAS |

CALIFORNIA (CA)

| | |
|---|---|
| SAN DIEGO | ESCONDIDO |
| FRESNO | MONTEREY |
| SAN FRANCISCO | ORANGE |
| ALAMEDA | PALM SPRINGS |
| LOS ANGELES | PASADENA |
| BERKELEY | SACRAMENTO |
| BURBANK | SAN LUIS OBISPO |

COLORADO (CO)

| | |
|---|---|
| COLORADO SPRINGS | CHEYENNE |
| BOULDER | GUNNISON |
| PUEBLO | MONTEZUMA |
| DURANGO | SAGUACHE |
| GREELEY | EL PASO |
| DENVER | AURORA |
| FT. COLLINS | KIT CARSON |

CONNECTICUT (CT)

| | |
|---|---|
| BRIDGEPORT | DANBURY |
| NEW HAVEN | GROTON |
| HARTFORD | GREENWICH |
| NEW LONDON | NAUGATUCK |
| NORWICH | PAWCATUCK |
| WATERBURY | PAQUABUCK |
| MERIDEN | UNCASVILLE |

DELAWARE (DE)

| | |
|---|---|
| BELLEFONTE | YORKLYN |
| DOVER | WILMINGTON |
| CONVENTRY | FRANKFORD |
| DEVENSHIRE | NEW CASTLE |
| DUNLEITH | MILLSBORO |
| HOCKESSIN | MIDDLETOWN |
| MINQUADALE | DuPONT MANOR |

FLORIDA (FL)

| | |
|---|---|
| ALACHUA | MIAMI |
| APALACHICOLA | OKEECHOBEE |
| CHATTAHOOCHEE | PENSACOLA |
| IMMOKALEE | SARASOTA |
| ISLAMORADA | TALLAHASSEE |
| KISSIMMEE | THONOTASASSA |
| LOXAHATCHEE | WAIMAUMA |

GEORGIA (GA)

| | |
|---|---|
| ATLANTA | MACON |
| CALHOUN | MUSCOGEE |
| CHATTAHOOCHEE | REHOBOTH |
| COLUMBUS | SAVANNAH |
| DECATUR | TALLAPOOSA |
| FAYETTEVILLE | VALDOSTA |
| GREENSBORO | ALBANY |

HAWAII (HI)

| | |
|---|---|
| HILO | NANAKULI |
| HONOLULU | WAILUA |
| KAHULUI | WAIMEA |
| KAUAI | PEAR CITY |
| KEKAHA | CAPTAIN COOK |
| KILAUEA | KAHULUI |
| WAIKIKI | KAUNAKAKAI |

IDAHO (ID)

| | |
|---|---|
| CARIBOU | ONEIDA |
| BOISE | SHOSHONE |
| CLEARWATER | SUN VALLEY |
| IDAHO FALLS | TWIN FALLS |
| KOOSKIA | POCATELLO |
| LINCOLN | TETON |

-continued

| | |
|---|---|
| MONTPELIER | HEADQUARTER |

ILLINOIS (IL)

| | |
|---|---|
| WATERLOO | DECATUR |
| ELGIN | PEORIA |
| BISMARCK | HARRISBURG |
| BRIDGEPORT | HENDERSON |
| CHICAGO | ILLIOPOLIS |
| CHILICOTHE | KANKAKEE |
| SPRINGFIELD | MACON |

INDIANA (IN)

| | |
|---|---|
| DECATUR | NAPPANEE |
| EVANSVILLE | SANTA CLAUS |
| FT. WAYNE | TERRE HAUTE |
| INDIANAPOLIS | TIPPECANOE |
| KOKOMO | VALPARAISO |
| MADISON | WABASH |
| MISHAWAKA | WATERLOO |

IOWA (IA)

| | |
|---|---|
| ALTOONA | MADISON |
| CHEROKEE | MT. VERNON |
| DAVENPORT | NASHUA |
| DES MOINES | NEW LONDON |
| DUBUQUE | SIOUX CITY |
| KANAWHA | TOLEDO |
| KEOKUK | WATERLOO |

KANSAS (KS)

| | |
|---|---|
| ABILENE | INDEPENDENCE |
| CHATAUQUA | KANAPOLIS |
| CLEARWATER | KANSAS CITY |
| COUNTRYSIDE | LEAVENWORTH |
| TOPEKA | POTTAWOTOMILE |
| EMPORIA | SALINA |
| FRANKFORT | WICHITA |

KENTUCKY (KY)

| | |
|---|---|
| BOONEVILLE | LEXINGTON |
| BOWLING GREEN | LOUISVILLE |
| CAMPBELLSVILLE | MORGANTOWN |
| DANVILLE | ONEIDA |
| FRANKFORT | PADUCAH |
| FRANKLIN | PROVIDENCE |
| KNOTTSVILLE | RICHMOND |

LOUISIANA (LA)

| | |
|---|---|
| SHREVEPORT | BOGALUSA |
| ALEXANDRIA | MORGAN CITY |
| BATON ROUGE | NATCHITOCHES |
| LAFAYETTE | PONCHATOULA |
| NEW ORLEANS | ST. FRANCISVILLE |
| LAKE CHARLES | TANGIPAHOA |
| NEW IBERIA | WELCOME |

MAINE (ME)

| | |
|---|---|
| AUGUSTA | MATTAWAMKEAG |
| LEWISTON | MONMOUTH |
| PORTLAND | PENOBSCOT |
| BANGOR | ROCKPORT |
| ANDROSCOGGIA | WISCASSET |
| DANFORTH | YARMOUTH |
| KENNEBUNKPORT | BOOTHBAY |

MARYLAND (MD)

| | |
|---|---|
| ABERDEEN | OCEAN CITY |
| BETHESDA | REISTERSTOWN |
| BALTIMORE | TOWSON |
| ANNAPOLIS | SUITLAND |
| HAGERSTOWN | SALISBURY |
| CHEVY CHASE | WESTMINSTER |
| HAVRE de GRACE | CAMBRIDGE |

MASSACHUSETTS (MA)

| | |
|---|---|
| SPRINGFIELD | HYANNIS |
| WORCHESTER | QUINCY |
| SALEM | CONCORD |
| NEW BEDFORD | MANCHESTER |
| BOSTON | NANTUCKET |
| FALL RIVER | STURBRIDGE |
| FALMOUTH | BROCKTON |

MICHIGAN (MI)

| | |
|---|---|
| ANN ARBOR | LANSING |
| BATTLE CREEK | MENOMINEE |
| CARSON CITY | SAGANAW |
| DETROIT | SANDUSKY |
| FLINT | SAULT STE MARIE |
| GRAND HAVEN | YPSILANTE |

-continued

| | |
|---|---|
| JACKSON | ZILWAUKEE |
| MINNESOTA (MN) | |
| ANOKA | McLEOD |
| BLOOMINGTON | MINNEAPOLIS |
| CHIPPEWA | MINNETONKA |
| DULUTH | ROCHESTER |
| ST. PAUL | ST. CLOUD |
| GRAND RAPIDS | WINNEBAGO |
| LITTLE FALLS | JACKSON |
| MISSISSIPPI (MS) | |
| BILOXI | MERIDIAN |
| CHOCTAW | NATCHEZ |
| DECATUR | TALLAHATCHIE |
| HATTIESBURG | TISHOMINGO |
| JACKSON | VICKSBURG |
| KISCIUSKO | YALOBUSKA |
| LAUREL | INDIANOLA |
| MISSOURI (MO) | |
| ATCHISON | LINCOLN |
| BOONE | ST. LOUIS |
| CAPE GIRARDEAU | SALISBURY |
| CHILLICOTHE | SPRINGFIELD |
| HANNIBAL | TARKIO |
| INDEPENDENCE | VANDALIA |
| JEFFERSON CITY | JOPLIN |
| MONTANA (MT) | |
| BIG HORN | HUNGRY HORSE |
| ABSAROKEE | LEWIS & CLARK |
| BOZEMAN | MEDICINE LAKE |
| HELENA | POWDER RIVER |
| BUTTE | STILLWATER |
| CUSTER | THREE FORKS |
| GREAT FALLS | GLACIER |
| NEBRASKA (NE) | |
| NORTH PLATTE | BOYS TOWN |
| LINCOLN | CEDAR BLUFF |
| OMAHA | DECATUR |
| NORFOLK | INDIANOLA |
| SCOTTSBLUFF | TECUMSEH |
| OGALLALLA | WAHOO |
| AURORA | WINNEBAGO |
| NEVADA (NV) | |
| RENO | TONOPAH |
| LAS VEGAS | ZEPHER COVE |
| BOULDER CITY | MESQUITE |
| WINNEMUCCA | PARADISE |
| CARSON CITY | INDIAN SPRINGS |
| ESMERALDA | HAWTHORNE |
| ALAMO | BOULDER CITY |
| NEW HAMPSHIRE (NH) | |
| FRANCONIA | NEWPORT |
| HAMSTEAD | DOVER |
| MANCHESTER | BENNINGTON |
| CONCORD | NEW LONDON |
| NASHUA | WALPOLE |
| PORTSMOUTH | LACONIA |
| ROCKINGHAM | LONDONDERRY |
| NEW JERSEY (NJ) | |
| TRENTON | OCEAN CITY |
| CAMDEN | MONOMOUTH |
| ATLANTIC CITY | PENNSAUKEN |
| ELIZABETH | VINELAND |
| LAKE HURST | PATERSON |
| HOBOKEN | CAPE MAY |
| NEWARK | CHEESEQUAKE |
| NEW MEXICO (NM) | |
| CARLSBAD | LAS VEGAS |
| GALLUP | NAVAJO |
| ALAMOGORDO | LOS ALAMOS |
| OJO CALIENTE | SANTA FE |
| TOHATCHI | SILVER CITY |
| ALBUQUERQUE | AZTEC |
| HANOVER | ROSWELL |
| NEW YORK (NY) | |
| NIAGARA FALLS | UTICA |
| ALBANY | ATTICA |
| CANANDAIGUA | SYRACUSE |
| ITHACA | TICONDEROGA |
| NEW YORK CITY | NISKAYUNA |
| ONEIDA | ROCHESTER |

-continued

| | |
|---|---|
| SARATOGA | BUFFALO |
| NORTH CAROLINA (NC) | |
| DURHAM | ROCKY MOUNT |
| CHARLOTTE | ASHEVILLE |
| BOONEVILLE | GREENSBORO |
| GOLDSBORO | SALISBURY |
| RELEIGH | TRANSYLVANIA |
| NASHVILLE | WILMINGTON |
| PASQUOTANK | WINSTON SALEM |
| NORTH DAKOTA (ND) | |
| DICKINSON | PIERCE |
| ELGIN | SHEYENNE |
| ALBERCROMBIE | TIOGA |
| BISMARK | WAHPETON |
| FARGO | ZAP |
| GRAND FORKS | MADAREE |
| MINNEWAKAN | LISBON |
| OHIO (OH) | |
| COLUMBUS | STEUBENVILLE |
| TOLEDO | GALLISPOLIS |
| YOUNGSTOWN | CHILLICOTHE |
| DAYTON | ONEIDA |
| CINCINNATI | WAPAKONETA |
| AKRON | ZANESVILLE |
| COSHOCTON | MASSILLON |
| OKLAHOMA (OK) | |
| TULSA | CHEROKEE |
| MUSKOGEE | INDIAHOMA |
| OKLAHOMA CITY | GERONIMO |
| LAWTON | ATOKA |
| POTTAWATOMIE | BILLINGS |
| STILLWATER | CUSTER |
| OREGON (OR) | |
| MULTNOMAH | MILWAUKIE |
| ASTORIA | ST. HELENA |
| COOS BAY | UMATILLA |
| DAYTON | WINCHESTER |
| BUNKER HILL | MC MINNVILLE |
| EUGENE | SALEM |
| PORTLAND | OREGON CITY |
| PENNSYLVANIA (PA) | |
| PITTSBURGH | HARRISBURG |
| READING | LEHIGH |
| LANCASTER | NESQUEHONING |
| SCRANTON | PHILADELPHIA |
| ALTOONA | VALLEY FORGE |
| ERIE | TOUGHKENAMON |
| PUNXSUTAWNEY | GETTYSBURG |
| RHODE ISLAND (RI) | |
| KINGSTON | JAMESTOWN |
| NEWPORT | CHAPACHET |
| QUONOCHONTAUG | BARRINGTON |
| PROVIDENCE | BRISTOL |
| WARWICK | PASCOAG |
| MIDDLETOWN | CRANSTON |
| WOONSOCKET | GREENVILLE |
| SOUTH CAROLINA (SC) | |
| BEAFORT | DARLINGTON |
| MYRTLE BEACH | BOWLING GREEN |
| PIEDMONT | GREENVILLE |
| SCRANTON | HILTON HEAD ISLAND |
| TRAVELERS REST | LEXINGTON |
| COLUMBIA | SPARTANBURG |
| YEMASSEE | OLANTA |
| SOUTH DAKOTA (SD) | |
| AURORA | KENNEBEC |
| CUSTER | LINCOLN |
| FALL RIVER | RAPID CITY |
| GETTYSBURG | SIOUX FALLS |
| IROQUOIS | MINNEHAHA |
| JACKSON | CHARLESTON |
| PIERRE | DARLINGTON |
| TENNESSEE (TN) | |
| ANDERSON | GATLINBURG |
| KNOXVILLE | PORTLAND |
| MEMPHIS | SAVANNAH |
| CHATTANOOGA | MONTGOMERY |
| SEQUATCHIE | LEXINGTON |
| JACKSON | KINGPORT |
| NASHVILLE | FAYETTEVILLE |

-continued

| | |
|---|---|
| TEXAS (TX) | |
| SAN ANTONIO | FT. WORTH |
| ODESSA | TEXARKANA |
| CORPUS CHRISTI | GALVESTON |
| DALLAS | HOUSTON |
| WAXAHACHIE | NACOGDOEHES |
| AUSTIN | RENO |
| WICHITA FALLS | SANTA FE |
| UTAH (UT) | |
| LOGAN | SYRACUSE |
| SALINA | REDWOOD |
| PROVO | PANGUITCH |
| BRIGHAM CITY | MONROE |
| MONTICELLO | COPPERTON |
| SALT LAKE CITY | BEAR RIVER CITY |
| OGDEN | GOSHEN |
| VIRGINIA (VA) | |
| CHARLOTTESVILLE | APPOMATTOX |
| LYNCHBURG | LEXINGTON |
| RICHMOND | ARLINGTON |
| NEWPORT NEWS | WILLIAMSBURG |
| ROANOKE | NORFOLK |
| CHINCOTEAGUE | QUANTICO |
| PORTSMOUTH | TAPPAHANNOCK |
| VERMONT (VT) | |
| CONCORD | BRATTLEBORO |
| ESSEX | BARRE |
| MANCHESTER | HARTFORD |
| RUTLAND | NEWPORT |
| WATERBURY | WILMINGTON |
| MONTPELIOR | BURLINGTON |
| GROTON | BELLOWS FALLS |
| WASHINGTON (WA) | |
| SEATTLE | WALLA WALLA |
| BREMERTON | SNOHOMISH |
| TACOMA | BURLINGTON |
| SPOKANE | DES MOINES |
| YAKIMA | MT. VERNON |
| OLYMPIA | REDONDO |
| NAVY YARD CITY | KENNEWICK |
| WEST VIRGINIA (WV) | |
| CHARLESTON | MARTINSBURG |
| PARKERSBURG | CLARKSBURG |
| WHEELING | BRIDGEPORT |
| BECKLEY | HARPERS FERRY |
| FAYETTEVILLE | MONTGOMERY |
| TRIADELPHIA | BLUEFIELD |
| RALEIGH | LEWISBURG |
| WISCONSIN (WI) | |
| GREEN BAY | ALTOONA |
| LAC du FLAMBEAU | BANGOR |
| MENOMINEE | EAU CLAIRE |
| PEWAUKEE | WATERLOO |
| MILWAUKEE | WAUSAU |
| MADISON | WAUWATOSA |
| PRAIRE du CHIEN | CHIPPEWA FALLS |
| WYOMING (WY) | |
| PINE BLUFFS | SWEETWATER |
| SARATOGA | NEWCASTLE |
| LARAMIE | THERMOPOLIS |
| BIG HORN | SHERIDAN |
| BUFFALO | CASPER |
| CHEYENNE | DOUGLAS |
| MEDICINE BOW | JACKSON |

Bonus cards have the following questions set forth on ten individual cards.

BONUS CARDS

Which state is northernmost except Alaska?

Which is further west - Hawaii or Alaska?

Name two Middle Atlantic States on the Atlantic Ocean separated by a large bay.

Point Pelee Canada in west central Lake Erie is the southernmost part of Canada. How many states in the continental United States are further north?

What peninsula consists of three states?

What state(s) east of Illinois is further west than Chicago?

How many states border on Mexico?

Name two states with active volcanoes.

What state is Transylvania in?

Give the abbreviations for Maine, Massachusetts, Montana, Maryland, Missouri, Mississippi.

Variations of my game can be played without deviating from the objects of learning geographical locations within the United States.

Having thus described the invention, what is claimed and desired to be secured by Letters Patent is:

1. Method of playing a geographical educational game having a game board with all fifty U. S. state flags depicted together with groups of contiguous states, playing cards with each card naming a state and multiple cities within the state, multiple bonus cards with questions concerning the state locations of cities depicted on each card, and play money, the method of play comprising:

the first player selecting a playing card and reading the name of the state, its abbreviation and the names of multiple cities within the state set forth on the card, the first player then receiving a quantity of play money for correctly pronouncing the city names, additional play money for naming the state capitol, additional play money for selecting the correct geographical location of the state on the game board and additional play money for pointing out the state flag on the game board, the first player having the opportunity of selecting a bonus card if all the selections with respect to the playing card are correct, the first player receiving additional play money for correctly answering the question on the bonus card, the second and all succeeding players in rotation continuing the same steps as for the first player until all fifty playing cards are exhausted and the player having the most money after the playing cards are exhausted being declared the winner.

2. The method of play according to claim 1 wherein a player orally challenges another player to name all the state capitols in a group of states and wagers a sum of play money that the challenged player cannot respond accurately.

3. The method of play according to claim 1 wherein the playing card lists fourteen cities within the state and the player reads all fourteen.

* * * * *